US006889862B2

(12) United States Patent
Vaughan

(10) Patent No.: US 6,889,862 B2
(45) Date of Patent: May 10, 2005

(54) LARGE OPENING BEVERAGE CONTAINER

(75) Inventor: Joseph S Vaughan, Broomfield, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 10/656,421

(22) Filed: Sep. 5, 2003

(65) Prior Publication Data

US 2004/0056032 A1 Mar. 25, 2004

Related U.S. Application Data

(60) Provisional application No. 60/412,435, filed on Sep. 19, 2002.

(51) Int. Cl.[7] ..... B65D 17/34
(52) U.S. Cl. ..... 220/269
(58) Field of Search ..... 220/269, 270, 220/906

(56) References Cited

U.S. PATENT DOCUMENTS

| | | | | |
|---|---|---|---|---|
| 3,334,775 | A | 8/1967 | Klein et al. | 220/48 |
| 3,967,752 | A | 7/1976 | Cudzik | 220/269 |
| 4,015,744 | A | 4/1977 | Brown | 220/269 |
| 4,024,981 | A | 5/1977 | Brown | 220/269 |
| 4,148,410 | A | 4/1979 | Brown | 220/269 |
| 4,150,765 | A | 4/1979 | Mazurek | 220/269 |
| 4,210,257 | A | 7/1980 | Radtke | 220/269 |
| 4,276,993 | A | 7/1981 | Hasegawa | 220/269 |
| 4,286,728 | A | 9/1981 | Fraze et al. | 220/270 |
| D279,265 | S | 6/1985 | Turner et al. | D9/438 |
| D285,661 | S | 9/1986 | Brownhill | D9/435 |
| 4,674,649 | A | 6/1987 | Pavely | 220/271 |
| 4,681,238 | A | 7/1987 | Sanchez | 220/260 |
| D300,608 | S | 4/1989 | Taylor et al. | D9/438 |
| D304,302 | S | 10/1989 | Dalli et al. | D9/438 |
| 4,893,725 | A | 1/1990 | Ball et al. | 220/269 |
| 5,064,087 | A | 11/1991 | Koch | 220/269 |
| 5,129,541 | A | 7/1992 | Voigt et al. | 220/269 |
| D337,521 | S | 7/1993 | McNulty | D9/438 |
| D352,898 | S | 11/1994 | Vacher | D9/438 |
| 5,494,184 | A | 2/1996 | Noguchi et al. | 220/269 |
| 5,711,448 | A | 1/1998 | Clarke, III | 220/269 |
| D406,236 | S | 3/1999 | Brifcani et al. | D9/438 |
| 6,024,239 | A | 2/2000 | Turner et al. | 220/269 |
| 6,050,440 | A | 4/2000 | McEldowney | 220/269 |
| 6,164,480 | A | 12/2000 | Heinicke et al. | 220/269 |
| 6,260,728 | B1 * | 7/2001 | Turner et al. | 220/269 |
| 6,405,889 | B1 | 6/2002 | Neiner | 220/269 |

* cited by examiner

*Primary Examiner*—Nathan J. Newhouse
(74) *Attorney, Agent, or Firm*—Sheridan Ross P.C.

(57) ABSTRACT

The present invention relates to an improved opening end closure which is adapted for interconnection to a beverage container to prevent premature rupturing and detachment of the tear panel from the center panel. More specifically, the present invention includes an improved cent bead, an enlarged score origination loop, and a pull tab with a cut-out portion with one leg longer than the other leg for selectively orienting the direction of force created on the tear panel away from the hinge portion of the tear panel.

21 Claims, 5 Drawing Sheets

LARGE OPENING BEVERAGE CONTAINER

This application claims priority of U.S. Provisional Patent Application Ser. No. 60/412,435, having a filing date of Sep. 19, 2002, the application being incorporated herein in its entirety by reference.

FIELD OF THE INVENTION

The present invention relates to beverage containers, and more specifically metallic container end closures which have a stay-on pull tab for selective opening.

BACKGROUND OF THE INVENTION

Beverage containers are used to store soft drinks, beer and other consumable liquids. These containers are generally comprised of metallic materials such as aluminum and are interconnected to a beverage "end closure" after being filled. The end closure is sealingly interconnected to an upper end of the beverage container by "double seaming" or other means well known in the art. To open the container for consumption, an "ecology tab" is typically interconnected to the end which allows the consumer to selectively open the container.

In an effort to save manufacturing and material costs, the thickness of end closures have been continually decreased, which increases the likelihood of premature opening along the score lines provided in the central panel. Furthermore, with the introduction of large opening end closures ("LOE's"), which increase the surface area of the tear panel for enhanced flow capabilities, it is more difficult for the elderly and other physically challenged users to shear the score lines with traditional pull tabs since a greater force is required. Furthermore, prior art pull tabs designed to decrease the opening force required to shear the score lines may also increase the likelihood of the tear panel detaching from the central panel.

As stated above, some prior art end closures have been known to inadvertently shear along the hinge point of the tear panel, which may allow the tear panel to inadvertently fall into the beverage container. This scenario is potentially dangerous due to the possibility of potential consumption by a user. To further exacerbate the problem mentioned above, certain beverage containers are now shipped in a non upright, horizontal position which exposes the internal score features of the central panel to low pH beverages. Over time, metal exposure to these liquids can diminish the metal thickness along the primary and secondary score and increase the likelihood of premature failure and leakage.

Previous attempts to solve some of the aforementioned problems have been addressed in the prior art. For example, U.S. Pat. No. 6,524,239 by American National Can Company (the '239 patent) describes an improved opening end closure which utilizes an improved central webbing of the tab positioned between the nose and lift end. The '239 patent is incorporated herein by reference in its entirety.

Thus, there is a significant need in the beverage industry to create a metallic end closure which is simplistic in design and easy to open, will not prematurely open or leak, and which has a tear panel which will not inadvertently become detached from the central panel. Preferably the improved end closure is used in conjunction with a large opening end ("LOE") type end closure, and is designed for the tear panel to open gradually, and thus reduce splashing. Thus, as described herein the following invention addresses the aforementioned problems described above.

SUMMARY OF THE INVENTION

It is thus one aspect of the present invention to provide a "stay-on" or ecology tab and associated container end closure which can be easily opened even when used in conjunction with LOE's and pressurized containers. It is another aspect of the present invention to provide an improved pull tab and score configuration which substantially prevents the possibility of the score panel detaching from the central panel and causing potential injury. Thus, in one embodiment of the present invention, a modified pull tab is provided which includes a "horseshoe shaped" cut-out portion which is positioned around the tab rivet. This improved tab orients the direction of force when pulled in a preferred direction, and further reduces the tab force on the hinge area and thus alleviates the likelihood of detachment. This horse-shoe shape cutout portion preferably has one "leg" which is longer than the opposing leg, and thus orients the direction of force exerted by the nose of the pull tab on a preferred location of the tear panel.

In a further aspect of the present invention, an improved "cent bead" configuration is provided to remove slack metal in the central panel proximate to, and around the rivet area, or "puckering", which diminishes the effectiveness of the pull tab during opening. The improved cent bead has been shortened, wherein the first leg and the second leg have been withdrawn toward the lift end of the pull tab about 0.10 inches. To further prevent detachment of the score panel, and to initiate panel tear in a preferred direction, an improved score origination loop is provided which has a larger loop radius of at least about 0.057" (as opposed to the prior art of 0.047"), and which creates a score opening path which is easier to initiate and thus prevents rupturing out of the score path and possible detachment of the tear panel.

It is thus a further aspect of the present invention to provide a metallic beverage container end which is not susceptible to premature openings, even when the product side of the container end is exposed to acidic and corrosive beverages during shipping or storage. Thus, in one aspect of the present invention an improved primary and secondary score is provided in the central panel which is made possible as a result of the improved pull tab and score design. The improved score has an increased "score residual", i.e. a thicker material which results in fewer premature openings and allows greater manufacturing tolerances. Thus, in one embodiment of the present invention the primary score has a score residual of between 0.00335–0.00424 inches as opposed to previous score residuals of 0.0033–0.0036 inches.

Thus in one embodiment of the present invention, an easy opening end closure is provided, comprising:

- a central panel having a product side and a public side and a peripheral curl adapted for interconnection to the container;
- a tear panel positioned in the central panel which is defined by a frangible primary score and a secondary score, and a non-frangible hinge portion, said tear panel originating with a score origination loop having a radius of curvature of at least about 0.050 inches;
- a stay on tab hingedly interconnected to said public side of said central panel comprising a nose portion on one end and a lift end on an opposing end, said nose portion extending over a portion of said tear panel;
- a reinforcing cent bead positioned within said central panel and having a first leg and a second leg positioned proximate to said rivet, opposite said tear panel, said first and second legs having a length no greater than about 0.125 inches; and
- a central webbing of said stay on tab positioned between said nose portion and said lift end, said webbing having a hinge region and a tab interconnected to said rivet, and further comprising a horseshoe shaped void region with a first leg and a second leg, said first leg extending a greater distance toward said nose than said second leg, wherein when said nose of said stay on tab is forced downward, a force on said tear panel is oriented away from said score origination loop.

DETAILED DESCRIPTION

Figure 1:
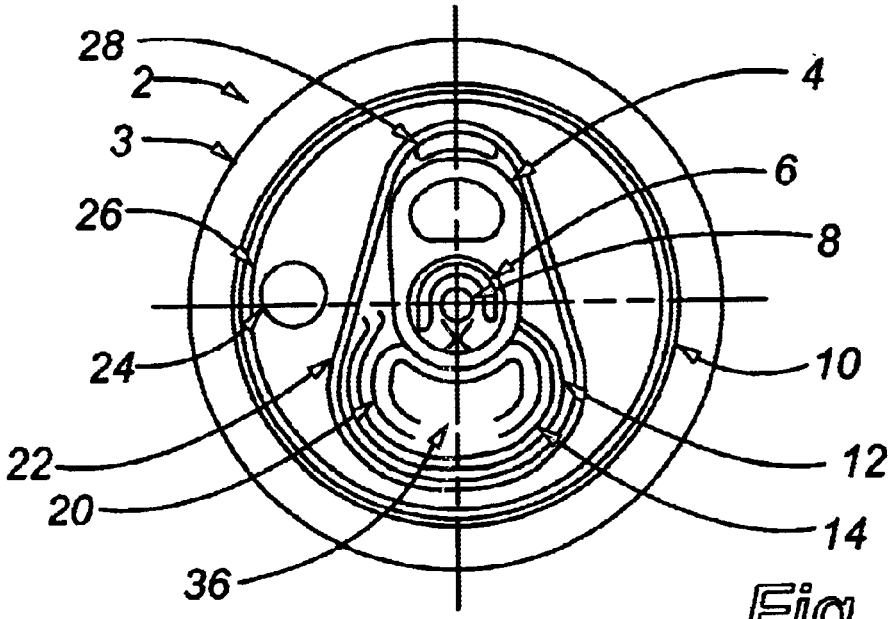
FIG. 1 is a top plan view showing the public side of a beverage container end closure and the components related thereto.
Figure 2:
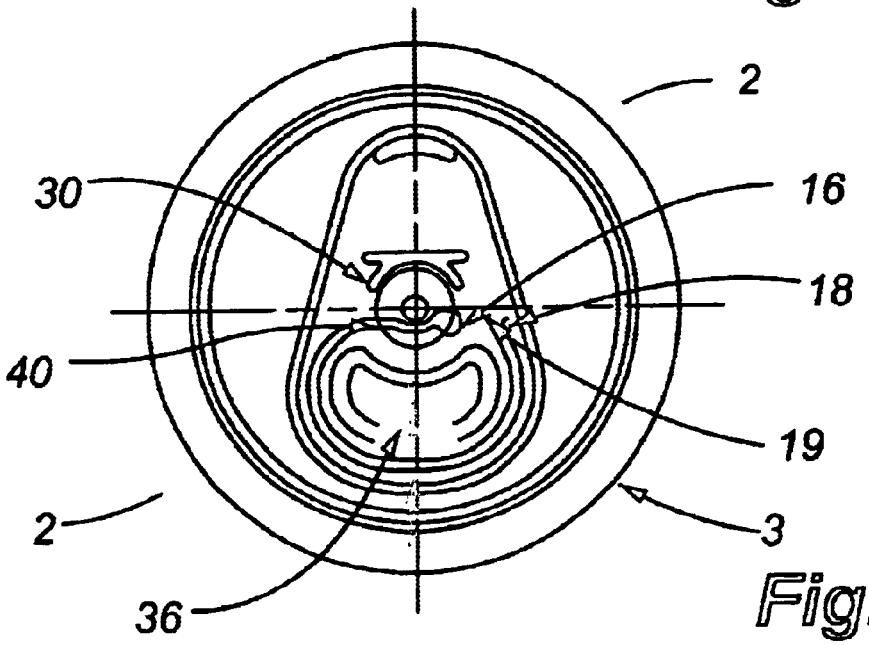
FIG. 2 is a bottom plan view of the beverage container end closure shown in FIG. 1 as viewed from the product side of the container.

Referring now to the drawings, FIGS. 1–6 represent one embodiment of the present invention, wherein an end closure 2 is provided which is adapted for double seaming or other interconnection means to a beverage container. More specifically, FIGS. 1 and 2 represent the public side and the product side, respectively of one embodiment of the present invention. As shown in a top plan view, the end closure 2 generally comprises a center panel 24 defined on an exterior perimeter by a countersink 10 which is interconnected to a peripheral curl 3. The center panel 24 is positioned within the circumference of the countersink 10, and generally comprises a pull tab 4 which is used for selectively opening the beverage end enclosure 2. The pull tab 4 is preferably a "stay on tab" which is retained on the end closure 2 after opening. In operation, when the pull tab lift end 44 is pulled upward, the pull tab nose 42 is driven downward into the tear panel 36. As force is continually provided, the tear panel 36 is torn away from the center panel 24 by means of a score, which generally comprises a primary score 12 and a secondary score 14, the primary score generally having a greater depth than the secondary score 14. As the tear panel 36 begins detachment from the center panel 24 along the score origination loop 16, the tear panel 36 begins deflecting downward and into the beverage container as the tear moves clockwise (as viewed from public side) and terminates at the score tail 18. Once the tear panel 36 is pushed downward from the center panel 24, the pull tab 4 may be pushed downward and the beverage consumed in a normal fashion, while the tear panel 36 remains attached to the center panel along the hinge point.

The present invention is primarily directed towards large opening ends (LOEs), but as appreciated by one skilled in the art may additionally be used for smaller opening ends traditionally used on beverage containers.

Referring now to FIG. 2, the product side (internal view) of the present invention shown in FIG. 1 is provided herein. More specifically, the score origination loop 16 as well as the score tail 18 can be shown in greater detail, as well as the rivet 8 used to hingedly interconnect the pull tab 4 to the center panel 24. As further shown in FIG. 2, an improved cent bead 30 is provided immediately adjacent the pull tab rivet, and includes a cent bead first leg 32 and a cent bead second leg 34. The cent bead is used to provide reinforcement around the rivet and eliminate slack in the metal, thus providing more efficient opening and reducing the likelihood of inadvertent tearing in the central panel 24 proximate to the hinge point of the tear panel 36.

The present invention generally describes four distinct features of an improved end closure 2 which serve the objectives of 1) reducing the force necessary on the pull tab to open the end closure; 2) substantially eliminating detachment of the tear panel 36 from the center panel 24; and 3) substantially preventing premature rupturing and leaking along the score lines of the central panel 24. To achieve these goals, at least four distinct features of the present invention are identified in further detail in FIGS. 3–6, and include: 1) an improved cent bead; 2) an offset horse-shoe cutout portion in the pull tab; 3) an enlarged score origination loop; and 4) an increased score residual in the center panel. However, it should be appreciated by one skilled in the art that each of these features is considered novel in their own respect, and represent a single novel concept which may be used independently or combined in one embodiment.

Figure 3A:
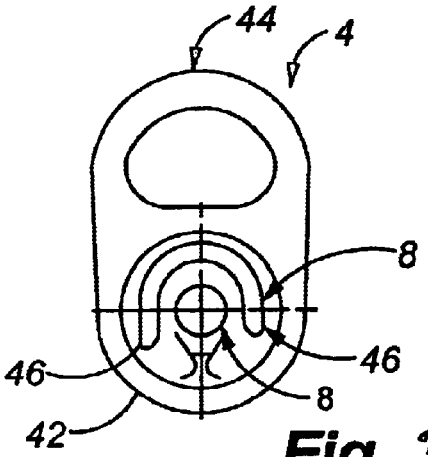
FIG. 3A is a top plan view showing a pull tab and improved horseshoe cut-out portion of the present invention.
Figure 3B:
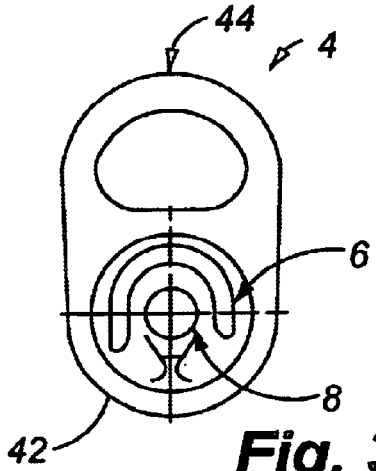
FIG. 3B depicts a prior art pull tab with rivet and cut-out portion.

Referring now to FIG. 3A, a top plan view of an improved pull tab 4 of the present invention is provided herein. FIG. 3B represents a prior art pull tab which is shown to clarify the distinctions between the two designs. As identified in these drawings, a traditional stay on pull tab 4 includes a pull tab lift end 44 which is used for grasping, wherein a user positions their fingers under the finger well 28 as shown in FIG. 1. The opposite side of the pull tab comprises a pull tab "nose" 42 which is used to drive the tear panel 36 downward when the pull tab lift end 44 is pulled upwardly and hingedly about the pull tab rivet 8, which interconnects the pull tab 4 to the central panel 24. Positioned substantially around the rivet 8 is a horse-shoe cutout portion 6 which allows the pull tab to be hingedly interconnected to the rivet 8. In one improved embodiment of the present invention, the horse-shoe cut out portion of the pull tab 6 has leg portions 46 which extend on either side of the rivet 8. In a preferred embodiment, one leg 46 is longer than the opposing leg, by a distance of at least about 0.035 inches, which serves the function of directing the force on the pull tab nose 42 in a preferred direction. By orienting the direction of force, the score and associated tear panel 36 tears away from the center panel 24 in a preferred clockwise direction as viewed from the public side shown in FIG. 1. By creating a tab which orients the direction of force in a preferred direction, i.e.

away from the score origination loop 16, the likelihood of the tear panel 36 being detached from the center panel 24 is found to be greatly reduced and the force required to rupture the score line for opening is significantly lessened. Furthermore, the opening is more gradual, thus reducing the likelihood of splashing upon opening.

Figure 4A:
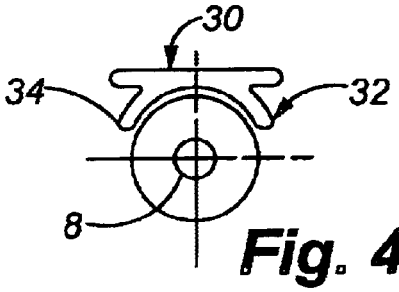
FIG. 4A is a top plan view of an improved cent bead of the present invention.
Figure 4B:
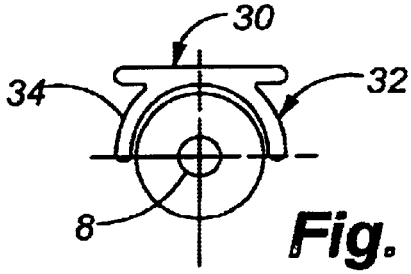
FIG. 4B is a top plan view of the prior art cent bead.

Referring now to FIGS. 4A and 4B, FIG. 4B represents a product side of a prior art cent bead 30 in more detail. FIG. 4A represent the improvement to the prior art design. In the embodiment of FIG. 4B, the cent bead first leg 32 and cent bead second leg 34 are shown to extend to substantially a mid point of the rivet 8. In the preferred embodiment of FIG. 4A, the cent bead first leg 32 and cent bead second leg 34 have a reduced length, and thus are positioned a greater distance away from the primary score origination loop 16 and score tail 18 of the present invention. By reducing the length of the cent bead legs from about 0.225 inches to about 0.125 inches, it has been found that slack metal is reduced between the score loop and the end of the cent bead, thus eliminating coin tears adjacent to the rivet and preventing tab "tuck unders" upon opening. As appreciated by one skilled in the art, a tab "tuck under" is an opening feature where the tab is rotated approximately 180 degrees without the score shearing and the end closure opening. To create the preferred effect shown in FIG. 4A, the Applicant has utilized a redesigned die during manufacturing with an improved taper.

Figure 5A:
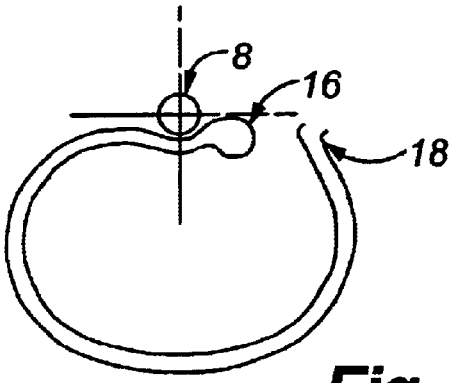
FIG. 5A is a top plan view showing the product side of an improved score loop.
Figure 5B:
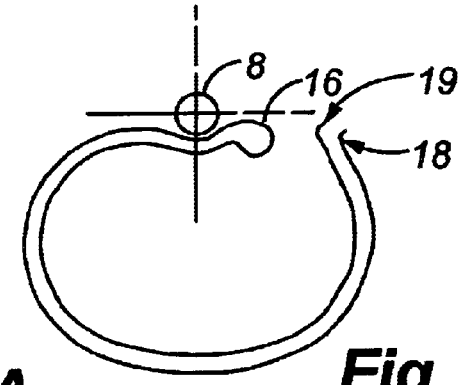
FIG. 5B is a prior art score loop shown from the product side.
Figure 6:
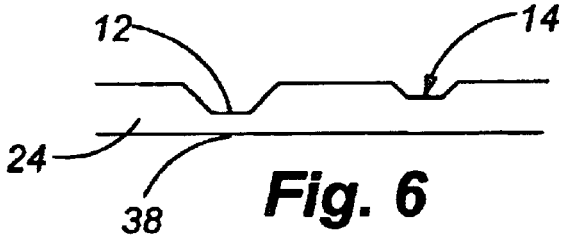
FIG. 6 is a cross sectional elevation view of a portion of the central panel of the present invention, and identifying a primary and secondary score, and the score residual.

Referring now to FIGS. 5A and 5B, FIG. 5B is a product side view of a prior art score loop, while FIG. 5A is a product side view of the improved score loop of the present invention. Two distinct attributes of the improved score loop shown in FIG. 5A are notable. First, the score origination loop 16 radius has been enlarged to at least about 0.050 inches, and preferably about 0.057 inches, as compared to the old loop origination of about 0.047 inches. The increased size of the score origination loop 16 has been found to ensure clockwise travel (as viewed from the public side) along the score line, which further eliminates the likelihood of tearing of the hinge portion and the possibility of the tear panel 36 being detached from the center panel 24. Furthermore, the score tail 18 has been directed outwardly in a direction towards the countersink 10 to assure that as the tear panel 36 is pushed downward by the tab nose 42, the tear is oriented downwardly away from the tear panel hinge portion 19 at an orientation of about 60 to 70 degrees.

As a result of the improvements shown in FIGS. 3A–5A, it has been possible to increase the metal thickness of the primary score 12 which is used to initiate opening of the end closure 2. A depiction of the depth of the primary score 12, secondary score 14 and score residual 38 can be seen in FIG. 6. More specifically, during the manufacturing of the end closure 2 and center panel 24, critical tolerances must be maintained during the manufacturing process to assure that the primary score 12 has sufficient score residual 38 to prevent premature opening, yet is shallow enough to promote easy opening. By utilizing the features shown in FIGS. 3A–5A, the manufacturing tolerances related to the depth of the primary score 12 may be reduced wherein the score residual 38 (thickness of the material) may now have a safe tolerance of between about 0.0035–0.0042 inches, as opposed to the prior art score residual of about 0.0033 to 0.0036. This slight modification greatly eliminates the likelihood of premature opening, while significantly improving manufacturing latitude. Thus, the various embodiments of the present invention allow for a beverage can end which is both easier to open, while preventing premature failure along the score lines and the inadvertent detachment of the tear panel 36 from the center panel 24.

Figure 7:
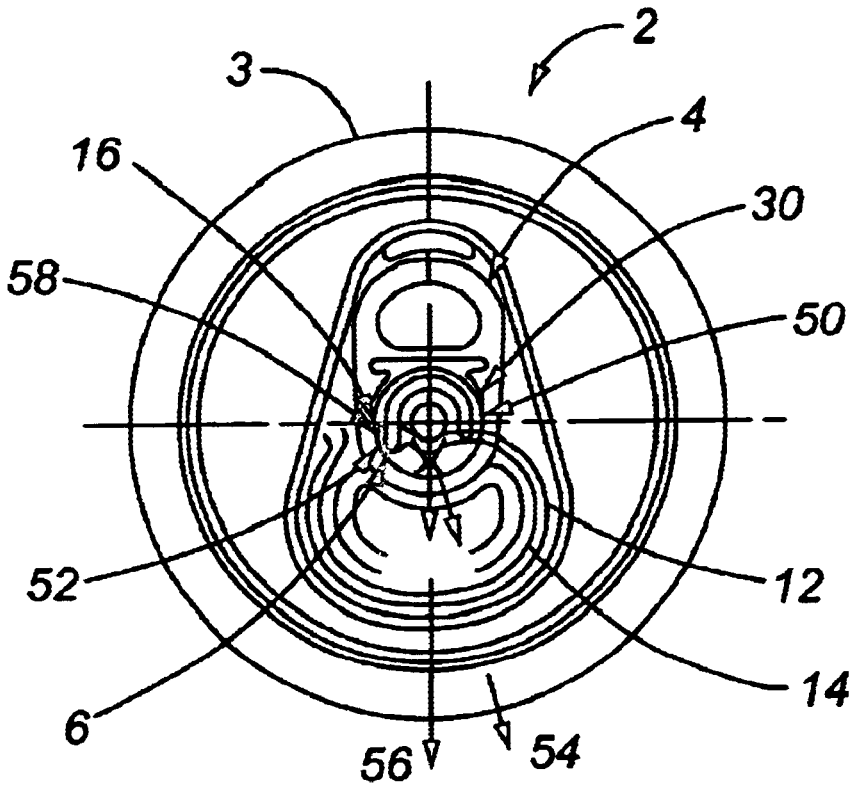
FIG. 7 is a top plan view of one embodiment of the present invention, and identifying the prior art and improvements of the end closure, and depicting the orientation of force imparted on the central panel from the pull tab.

Referring now to FIG. 7, a top plan view of the end closure 2 of the present invention is provided herein. More specifically, an end closure 2 is provided which has an opening force orientation 54 which is distinct from the orientation of prior art opening force 56. When combined with the other novel features of the present invention, an improved large opening end closure is provided which is easier to open, and less likely to have the tear panel detached from the center panel 24. As shown in the FIG. 7, the opening force 54 is oriented at a direction which is not parallel to the longitudinal axis of the pull tab 4. Furthermore, the additional improvements of the invention are provided in FIG. 7, and include a larger radius for the score origination loop 16, a longer second leg 48 on the horseshoe cutout 6, and shorter first leg 32 and second leg 34 of the cent bead 30.

Figure 8:
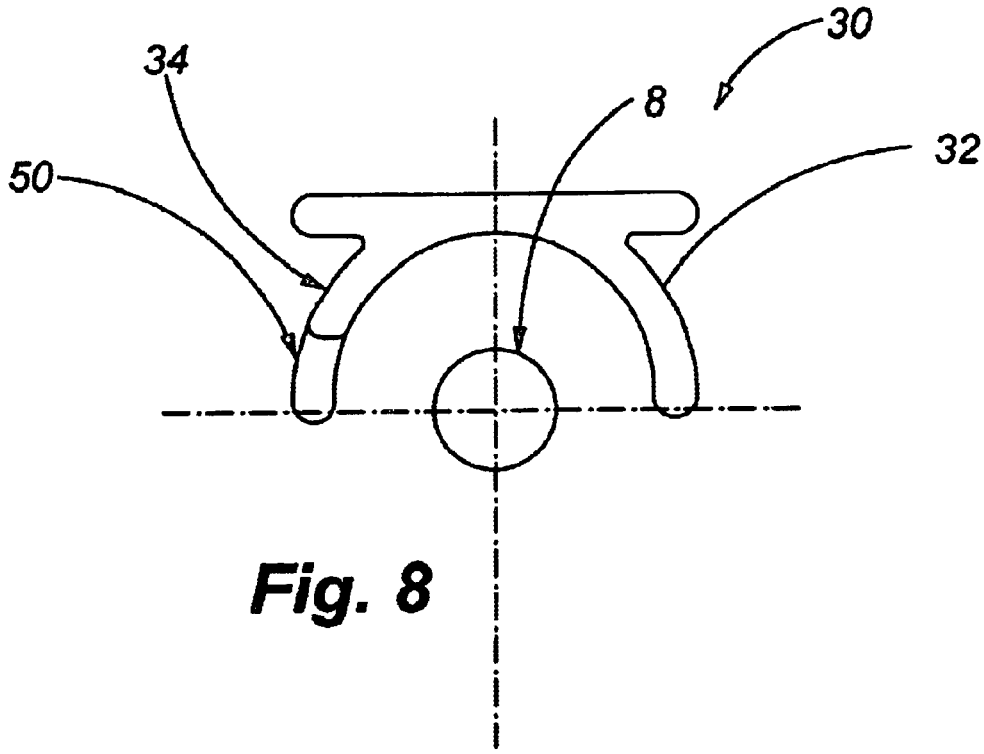
FIG. 8 is a top plan view depicting the prior art and an improved cent bead of the present invention.

More specifically, the improved cent bead 30, horseshoe cut-out 6, and larger score origination loop radius 16 are provided respectively in FIGS. 8–11. As seen in FIG. 8, a drawing of the improved cent bead 30 of the present invention is shown herein, and is superimposed over the prior art cent bead 50 which is depicted in dashed lines. As illustrated, the cent bead first leg 32 and cent bead second leg 34 of the present invention are significantly shorter than the cent bead first leg and cent bead second leg of the prior art cent bead 50. Further, the first leg 32 and second leg 34 are positioned closer to the pull tab lift end 44, as opposed to the prior art where the cent bead first leg 32 and second leg 34 extend substantially to a center line 64 of the rivet 8. Preferably, the first leg 32 and second leg 34 of the cent bead 30 are no closer than 0.090 inches from a centerline 64 of the rivet 8. This improved design has been shown to reduce slack metal between the score origination loop 16 and the cent bead 30, and thus help prevent tear panel 36 detachment from the center panel 24, and to prevent tab "tuck unders" during opening.

Figure 9:
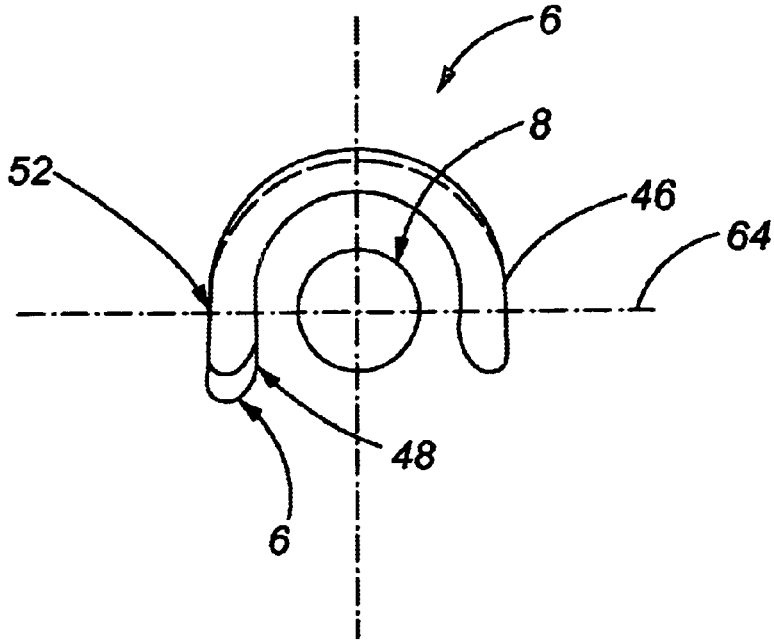
FIG. 9 is a top plan view depicting the prior art and an improved horseshoe cut-out of the present invention.

Referring now to FIG. 9, an improved horseshoe cut-out 6 of the present invention is provided herein, and more specifically identifies a horseshoe cut-out where the second leg 48 has been extended with regard to the prior art horseshoe cut-out 52, and also with respect to the horseshoe cut-out first leg 46. The prior art horseshoe cut-out is depicted in dashed lines, while the improved horseshoe cut-out 6 is shown in bold lines. By utilizing a horseshoe cut-out with the first and second legs having different lengths, the tear panel opening force 54 is oriented at an angle which is not parallel to the longitudinal axis of the pull-tab, or approximately 120–175 degrees, which helps prevent tearing and hence detachment of the tear panel 36 from the center panel 24.

Figure 10:
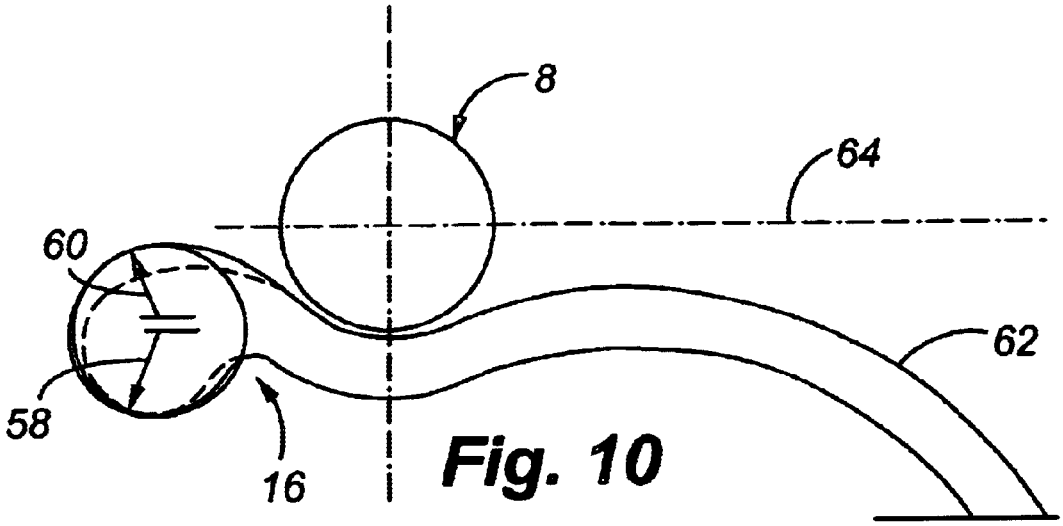
FIG. 10 is a top plan view depicting the prior art and an improved score loop of the present invention.
Figure 11:
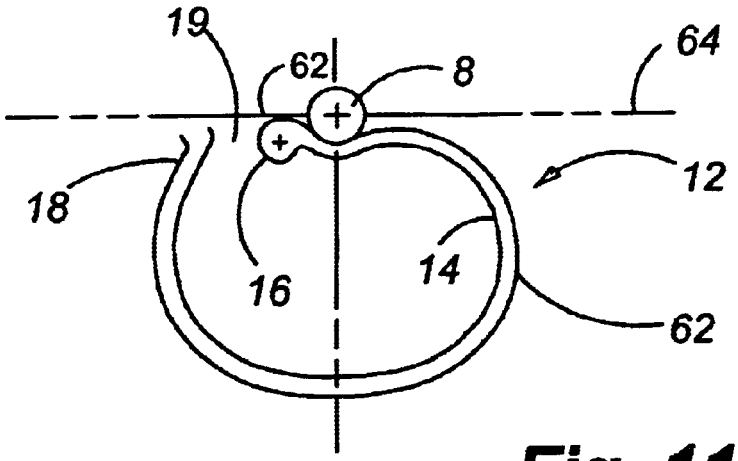
FIG. 11 is a top plan view depicting the prior art and the improved score origination loop of the present invention.

Referring now to FIGS. 10 and 11, a top plan view of a frangible score is provided which depicts the primary score 12, secondary score 14, a score origination loop 16, and a score tail 18. As shown, the score origination loop 16 is positioned proximate to the rivet 8, with the improvement lying in the score origination loop radius 58 being enlarged from approximately 0.047 inches to approximately 0.057 inches and the score tail is being oriented outwardly toward the peripheral cover hook. Further, the point of origin of the score origination loop radius 16 is approximately 0.1590 inches from the center line of the rivet 8. Through significant experimentation and trial and error, it has been shown that enlarging the score origination loop 16 provides the added benefit of creating clockwise travel along the score line, which further reduces the likelihood of the tear panel 36 becoming detached from the center panel 24.

To assist in the understanding of the invention, the following is a list of the components and associated numbering shown in the drawings.

| # | Component |
|---|---|
| 2 | End closure |
| 3 | Peripheral curl |
| 4 | Pull tab |
| 6 | Horse-shoe cut-out |
| 8 | Rivet |
| 10 | Countersink |
| 12 | Primary score |
| 14 | Secondary score |
| 16 | Score origination loop |
| 18 | Score tail |
| 19 | Tear panel hinge portion |
| 20 | Shadow bead |
| 22 | Deboss |
| 24 | Center panel |
| 26 | Coined center panel radius |
| 28 | Tab finger well |
| 30 | Cent bead |
| 32 | Cent bead first leg |
| 34 | Cent bead second leg |
| 36 | Tear panel |
| 38 | Score residual |
| 40 | Vent area |
| 42 | Pull tab nose |
| 44 | Pull tab lift end |
| 46 | Horseshoe cut-out first leg |
| 48 | Horseshoe cut-out second leg |
| 50 | Prior art cent bead |
| 52 | Prior art horseshoe cut-out |
| 54 | Orientation of opening fore |
| 56 | Prior art orientation of opening force |
| 58 | Prior art score origination loop radius |
| 60 | Score loop radius |
| 62 | Score |
| 64 | Rivet centerline |

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

What is claimed is:

1. An end closure adapted for interconnection to a container, comprising:

a central panel having a product side and a public side and a peripheral curl adapted for interconnection to the container;

a tear panel positioned in the central panel which is defined by a frangible primary score and a secondary score, and a non-frangible hinge portion, said tear panel originating with a score origination loop having a radius of curvature of at least about 0.050 inches;

a stay on tab hingedly interconnected to said public side of said central panel comprising a nose portion on one end and a lift end on an opposing end, said nose portion extending over a portion of said tear panel;

a reinforcing cent bead positioned within said central panel and having a first leg and a second leg positioned proximate to said rivet, opposite said tear panel, said first and second legs having a length no greater than about 0.125 inches; and a central webbing of said stay on tab positioned between said nose portion and said lift end, said webbing having a hinge region and a tab interconnected to said rivet, and further comprising a horseshoe shaped void region with a first leg and a second leg, said first leg extending a greater distance toward said nose than said second leg, wherein when said nose of said stay on tab is forced downward, a force on said tear panel is oriented away from said score origination loop.

2. The end closure of claim 1, wherein said second leg of said horse-shoe shaped void region is at least about 0.035 inches longer than said first leg.

3. The end closure of claim 1, wherein said first leg and said second leg of said cent bead are offset from said score tear panel at least about 0.125 inches.

4. The end closure of claim 1, wherein said frangible primary score has a residual material thickness of between about 0.0035–0.0042 inches.

5. The end closure of claim 1, wherein said score origination loop has a radius of about 0.057 inches.

6. The end closure of claim 1, wherein said force on said tear panel is oriented at an angle which is non-parallel to a longitudinal axis of said pull tab.

7. The end closure of claim 1, wherein said first leg and said second leg of said cent bead are off set from a center-line of said rivet a distance of about 0.900 inches.

8. The end closure of claim 1, wherein the opening force required to shear said frangible primary score on said tear panel to open said end closure is no greater than about 3.5 lbs.

9. The end closure of claim 1, wherein said frangible primary and secondary score terminate with a tail loop which is oriented outwardly towards said peripheral curl.

10. A metallic end closure adapted for interconnection to a container, comprising:

a central panel having a product side and a public side and a peripheral curl adapted for interconnection to a neck of the container;

a tear panel positioned in the central panel which is defined by at least a frangible primary score, originating with a score origination loop having a radius of curvature of at least about 0.050 inches and terminating with a tail loop;

a stay on tab hingedly interconnected to said public side of said central panel which includes a nose portion on one end and a lift end on an opposing end, said nose portion extending over a portion of said tear panel;

a reinforcing cent bead integrally interconnected to said central panel and having a first leg and a second leg positioned proximate to said rivet, opposite said tear panel, said first and second legs of said reinforcing bead having a length no greater than about 0.125 inches; and a central webbing of said stay on tab positioned between said nose portion and said lift end, said webbing having a hinge region and a tab interconnected to said rivet, and further comprising a horseshoe shaped void region with a first leg and a second leg, wherein when said nose of said stay-on tab is forced downward, a force on said tear panel is oriented away from said score loop.

11. The end closure of claim 10, wherein said second leg of said horse shoe shaped void region has a greater length than said first leg.

12. The end closure of claim 10, wherein said tear panel further comprises a frangible secondary score.

13. The end closure of claim 10, wherein said frangible primary score has a residual material thickness of between about 0.0035–0.0042 inches.

14. The end closure of claim 10, wherein said opening force is oriented in a non-parallel direction to a longitudinal axis of said stay on tab.

15. The end closure of claim 10, wherein said first and second legs of said cent bead are at least about 0.090 inches from a central axis of said rivet.

16. A metallic end closure adapted for interconnection to a container, comprising:

a central panel having a product side and a public side and a peripheral curl adapted for interconnection to a neck of the container;

a tear panel positioned in the central panel which is defined by at least a frangible primary score and a non-frangible hinge portion, said tear panel originating with a score origination loop and terminating with a tail loop;

a stay on tab hingedly interconnected to said public side of said central panel which includes a nose portion on one end and a lift end on an opposing end, said nose portion extending over a portion of said tear panel;

a reinforcing cent bead integrally interconnected to said central panel and having a first leg and a second leg positioned proximate to said rivet, opposite said tear panel, said first and second legs having a length no greater than about 0.125 inches; and a central webbing of said stay on tab positioned between said nose portion and said lift end, said webbing having a hinge region and a tab interconnected to said rivet, and further comprising a horseshoe shaped void region with a first leg and a second leg, said second leg extending a greater distance toward said nose than said first leg, wherein when said nose is forced downward, a force on said tear panel is oriented away from said score origination loop to substantially prevent detachment of said tear panel from said central panel.

17. The end closure of claim 16, wherein said score origination loop has a radius of curvature of at least about 0.050 inches.

18. The end closure of claim 16, wherein said first and second legs of said reinforcing cent bead are no closer than 0.090 inches from a center line of said rivet.

19. The end closure of claim 16, wherein said first leg of said horse shoe shaped void region is at least about 0.035 inches longer than said first leg.

20. The end closure of claim 16, wherein said frangible primary score has a residual material thickness of at least about 0.0035 inches.

21. The end closure of claim 16, wherein said tail loop is oriented outwardly toward said peripheral curl.

* * * * *